United States Patent [19]

Hibino et al.

[11] Patent Number: 4,715,349

[45] Date of Patent: Dec. 29, 1987

[54] AIR INTAKE SIDE SECONDARY AIR SUPPLY SYSTEM FOR AN INTERNAL COMBUSTION ENGINE WITH AN IMPROVED OPERATION UNDER A SMALL INTAKE AIR AMOUNT

[75] Inventors: Yoshitaka Hibino; Takeshi Fukuzawa, both of Wako, Japan

[73] Assignee: Honda Giken Kogyo Kabushiki Kaisha, Tokyo, Japan

[21] Appl. No.: 915,471

[22] Filed: Oct. 6, 1986

[30] Foreign Application Priority Data

Oct. 5, 1985 [JP] Japan ..... 60-222171
Oct. 14, 1985 [JP] Japan ..... 60-228443

[51] Int. Cl.[4] ..... F02M 23/08
[52] U.S. Cl. ..... 123/585; 123/589
[58] Field of Search ..... 123/585–589, 123/339

[56] References Cited

U.S. PATENT DOCUMENTS 4,356,797 11/1982 Matsui ..... 123/589
4,492,211 1/1985 Shimomura et al. ..... 123/589
4,579,099 4/1986 Kishida et al. ..... 123/589
4,580,541 4/1986 Koumura ..... 123/587
4,586,481 5/1986 Kishida et al. ..... 123/589
4,616,621 10/1986 Kuroiwa et al. ..... 123/585
4,617,889 10/1986 Nishimiya et al. ..... 123/585

*Primary Examiner*—William A. Cuchlinski, Jr.
*Attorney, Agent, or Firm*—Pollock, VandeSande & Priddy

[57] ABSTRACT

An air intake side secondary air supply system for an internal combustion engine is provided with a device for restricting the amount of the secondary air flowing through an air intake side secondary air supply passage when an amount of an intake air of the engine is small. By the provision of the flow restriction device, the operating range of an open-close valve or a linear type solenoid valve which is provided for controlling the air intake side secondary air, in which range the linearity of the operation of the valve is good, can be always used. Thus, the accuracy of the air/fuel ratio control is improved especially when the amount of the intake air of the engine is small.

4 Claims, 11 Drawing Figures

AIR INTAKE SIDE SECONDARY AIR SUPPLY SYSTEM FOR AN INTERNAL COMBUSTION ENGINE WITH AN IMPROVED OPERATION UNDER A SMALL INTAKE AIR AMOUNT

BACKGROUND OF THE INVENTION

1. Field of the Invention

The present invention relates to an air intake side secondary air supply system for an internal combustion engine, and more specifically to an air intake side secondary air supply system in which the operation of the system is improved when the amount of the intake air is small.

2. Description of Background Information

Air/fuel ratio feedback control systems for an internal combustion engine are known as systems in which oxygen concentration in the exhaust gas of the engine is detected by an oxygen concentration sensor (referred to as $O_2$ sensor hereinafter) and an air/fuel ratio of mixture to be supplied to the engine is feedback controlled in response to an output signal level of the $O_2$ sensor for the purification of the exhaust gas and improvements of the fuel economy. As an example of the air/fuel ratio feedback control system, an air-intake side secondary air supply system of a duty ratio control type is proposed, for example, in Japanese Patent Publication No. 55-3533 in which an open-close valve is disposed in an air intake side secondary air supply passage leading to a part of an intake manifold, downstream of a throttle valve of a carburetor, and a duty ratio of the open and close of the open-close valve, i.e. the supply of the air intake side secondary air, is feedback controlled in response to the output signal level of the $O_2$ sensor.

In such an air-intake side secondary air supply system of the duty ratio control type, the amount of the secondary air flowing through the open-close valve changes very little with respect to the change in the control signal in a small range (0~20%, for example) of the duty ratio which indicates a time proportion of the opening of the open-close valve in each of the duty period. However, under a condition in which the engine speed is low and the vacuum level in an intake manifold is high, e.g. when the engine is idling, the amount of air flowing through the throttle valve is relatively small, and consequently, the amount of the secondary air required for controlling the air/fuel ratio becomes also small. For this reason, the duty ratio must often be controlled into the small range. Thus, when the amount of the engine intake air is small, the air/fuel ratio control may become inaccurate with the conventional air intake side secondary air supply systems.

On the other hand, there is an air intake side secondary system in which a linear type solenoid valve is provided in the air intake side secondary air supply passage leading to the intake manifold. Such an air intake side secondary air supply system is disclosed, for example, in Japanese Patent Application laid-open No. 55-119941. In this system, an opening degree of the linear type solenoid valve is varies in response to the magnitude of a drive current supplied to its solenoid. With this solenoid valve, a sectional area of the air intake side secondary air supply passage is varied in response to a result of detection of the oxygen concentration in the exhaust gas.

In this type of air intake side secondary air supply system, the amount of the intake air as well as the amount of the secondary air for controlling the air/fuel ratio becomes small when the enginee speed is low and the vacuum in the intake manifold is high, for example, when the engine is idling. Therefore, if the linear type solenoid valve is constructed such that the openning degree increases as an increase of the drive current, the magnitude of the drive current to the solenoid valve becomes small under a condition mentioned above. However, in general, in the case of the linear type solenoid valve, the opening degree does not necessarily vary accurately in proportion to the change in the drive current. More specifically, the change in the opening degree per a unit current value becomes small when the magnitude of the drive current is small. Therefore, with conventional air/fuel ratio control systems of this type, the amount of the secondary air may deviate from the proper value, to reduce the accuracy of the air/fuel ratio control when the amount of the intake air of the engne is small. This is especially serious if the amount of the drive current is determined digitally by using a microcomputer having a CPU, and the resolution of the control is not high enough, or in other words, only a coarse control is performed by the digital control.

OBJECTS AND SUMMARY OF THE INVENTION

An object of the present invention is to provide a duty ratio control type air intake side secondary air supply system in which the accuracy of the air/fuel ratio control is improved especially when the amount of the intake air of the engine is small.

Another object of the present invention is to provide an air intake side secondary air supply system using a linear type solenoid valve for controlling the amount of the secondary air in which the accuracy of the air/fuel ratio control is improved especially when the amount of the intake air of the engine is small.

According to the present invention, an air intake side secondary air supply system is provided with a device for restricting the amount of the secondary air flowing through the secondary air passage when the amount of the intake air is small.

BRIEF DESCRIPTION OF THE DRAWINGS

FIGS. 3 through 5 are flowcharts showing the manner of operation of a CPU 29 in the control circuit 20 in a first embodiment of the present invention, in which FIG. 3 shows steps for detecting an amount of intake air, FIG. 4 shows a main routine, and FIG. 5 shows an A/F routine;

DETAILED DESCRIPTION OF THE PREFERRED EMBODIMENTS

Referring to the accompanying drawings, the first embodiment of the air intake side secondary air supply system according to the present invention will be explained hereinafter.

Figure 1:
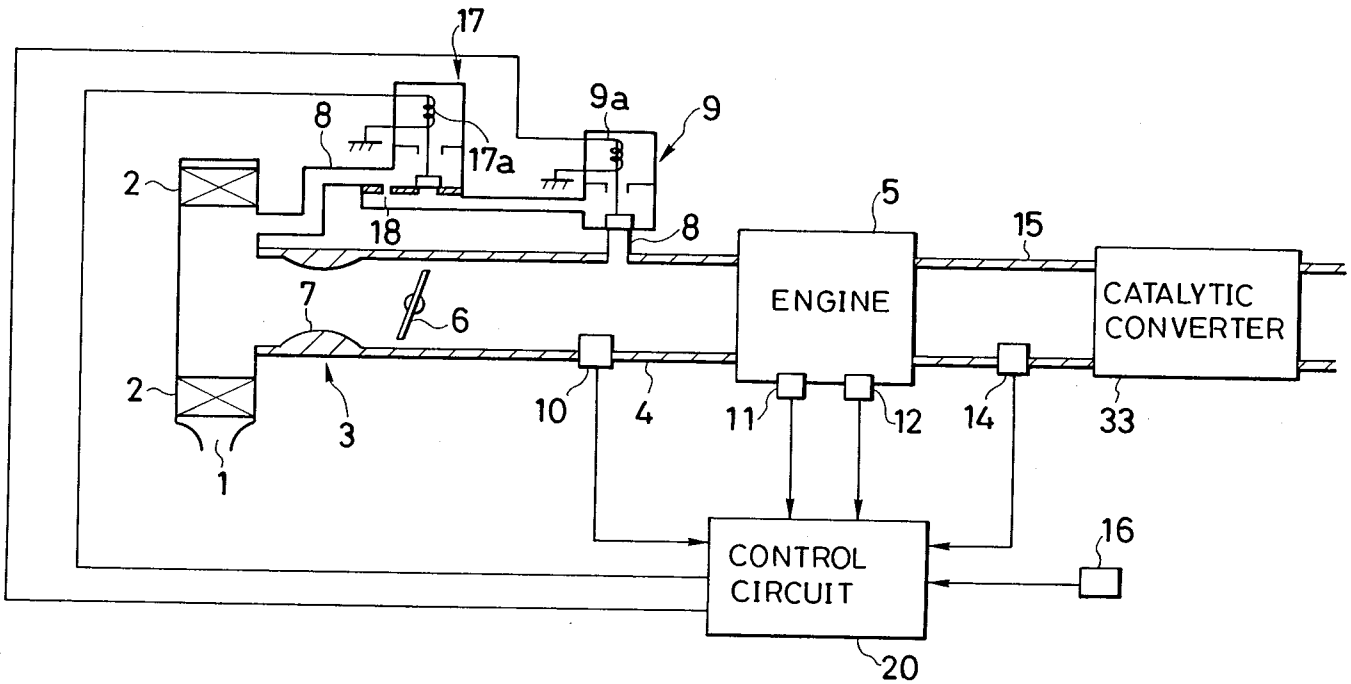
FIG. 1 is a schematic diagram showing a general construction of an air intake side secondary air supply system according to the invention.

In FIG. 1 which illustrates a general construction of the air intake side secondary air supply system for an automotive internal combustion engine, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with a first open-close solenoid valve 9. Further, a second open-close solenoid valve 17 and an orifice 18 operative as a restrictor which are arranged in parallel with each other, are provided in the air intake side secondary air supply passage 8, at a position upstream of the first open-close solenoid valve 9. In other words, a flow of the air intake side secondary air which bypasses the second open-close solenoid valve 17 flows through the orifice 18. With this structure, the amount of the secondary air flowing through the air intake side secondary air supply passage 8 when the second open-close solenoid valve 17 is closed becomes, for example, one tenth of the amount of the secondary air when the second open-close solenoid valve 17 is open.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of cooling water of the engine 5, and an $O_2$ sensor 14 which is provided in an exhaust manifold 15 of the engine for generating an output signal whose level varies in proportion to an oxygen concentration in the exhaust gas. Further, a catalytic converter 33 for accelerating the reduction of the noxious components in the exhaust gas is provided in the exhaust manifold 15 at a location on the downstream side of the position of the $O_2$ sensor 14. The first and second open-close solenoid valves 9 and 17, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is proportional to the speed of the vehicle is electrically connected to the control circuit 20.

Figure 2:
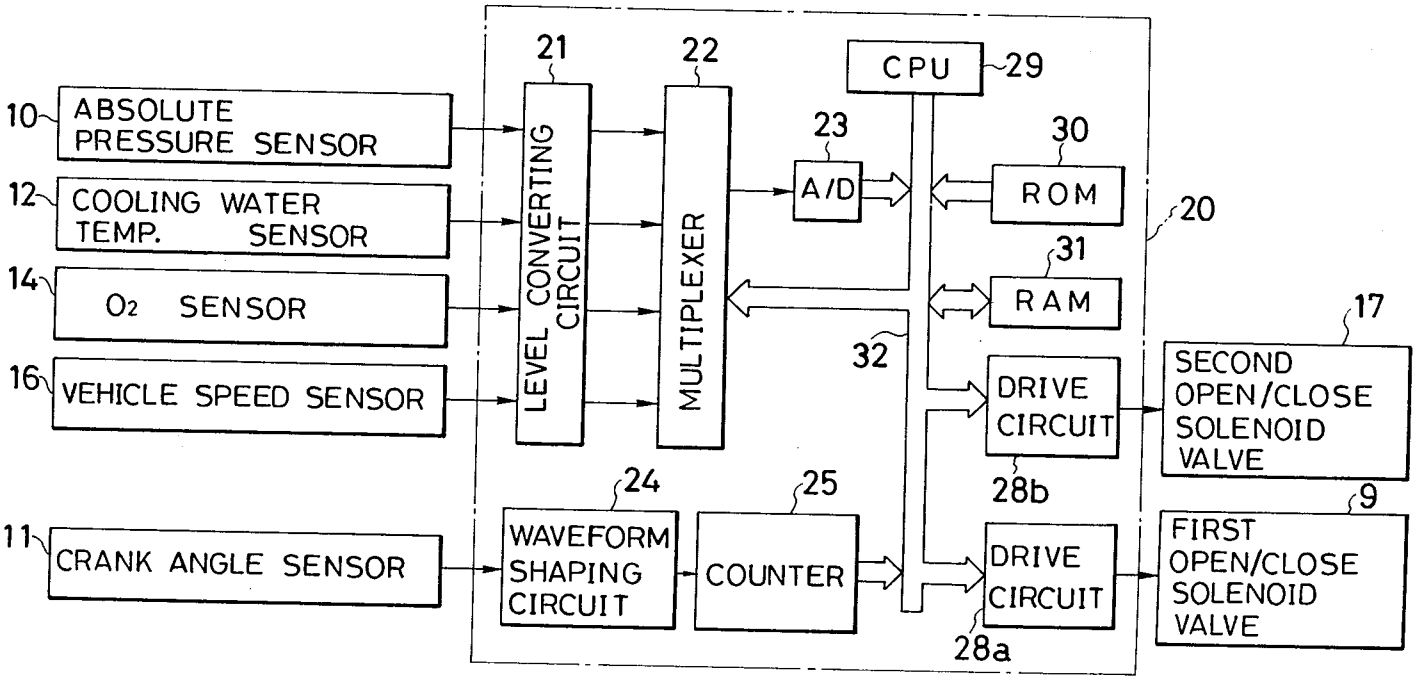
FIG. 2 is a block diagram showing the construction of the control circuit 20 of the system of FIG. 1.

FIG. 2 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28*a* for driving the first open-close solenoid valve 9 in an opening direction, a drive circuit 28*b* for driving the second open-close solenoid valve 17 in an opening direction, a CPU (central processing unit) 29 which performs digital operations according to various programs, and a ROM 30 in which various operating programs and data are previously stored, and a RAM 31. The multiplexer 22, the A/D converter 23, the counter 25, the drive circuits 28*a* and 28*b*, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every one duty period TSOL (100 m sec, for instance). In response to this internal interruption signal, the CPU 29 performs an operation for the duty ratio control of the air intake side secondary air supply, explained hereinafter. Apart from the operation in response to the internal interruption signal, the CPU 29 determines whether or not the second open-close solenoid valve 17 is to be opened at intervals of a predetermined time period or in synchronism with the rotation of the engine. When it is determined that the second open-close solenoid valve 17 is to be opened, the CPU provides a valve open command signal to the drive circuit 28*b* so that the second open-close solenoid valve 17 is opened.

Referring to the flowcharts of FIGS. 3 through 5, the operation of the air intake side secondary air supply system according to the present invention will be explained hereinafter.

Figure 3:
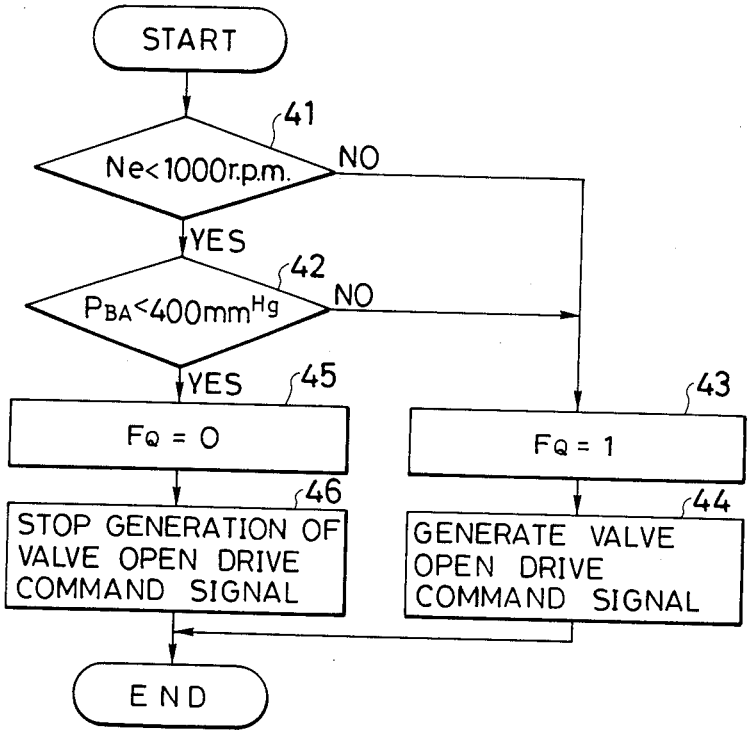

As shown in FIG. 3, whether or not the engine speed Ne is smaller than 1000 r.p.m. is detected at first by the CPU 29 at a step 41. If $Ne < 1000$ r.p.m., whether or not the absolute value of the pressure in the intake manifold $P_{BA}$ is smaller than 400 mmHg is detected at a step 42. If $Ne > 1000$ r.p.m. or $P_{BA} > 400$ mmHg, it is determined that the amount of the intake air is not small, and a value "1" is set for an intake air amount flag $F_Q$ at a step 43. Under this condition, a first valve open command signal is supplied to the drive circuit 28*b* at a step 44. In response to the first valve open command signal, the drive circuit 28*b* supplies a drive current to a solenoid 17*a* of the second open-close solenoid valve 17, to open it. On the other hand, if $Ne < 1000$ r.p.m. and at the same time PBA<400 mmHg, it is determined that the amount of the intake air is small, and a value "0" is set for the intake air amount flag $F_Q$ at a step 45. At the same time, the supply of the first valve open command signal to the drive circuit 28b is stopped at a step 46.

Figure 4:
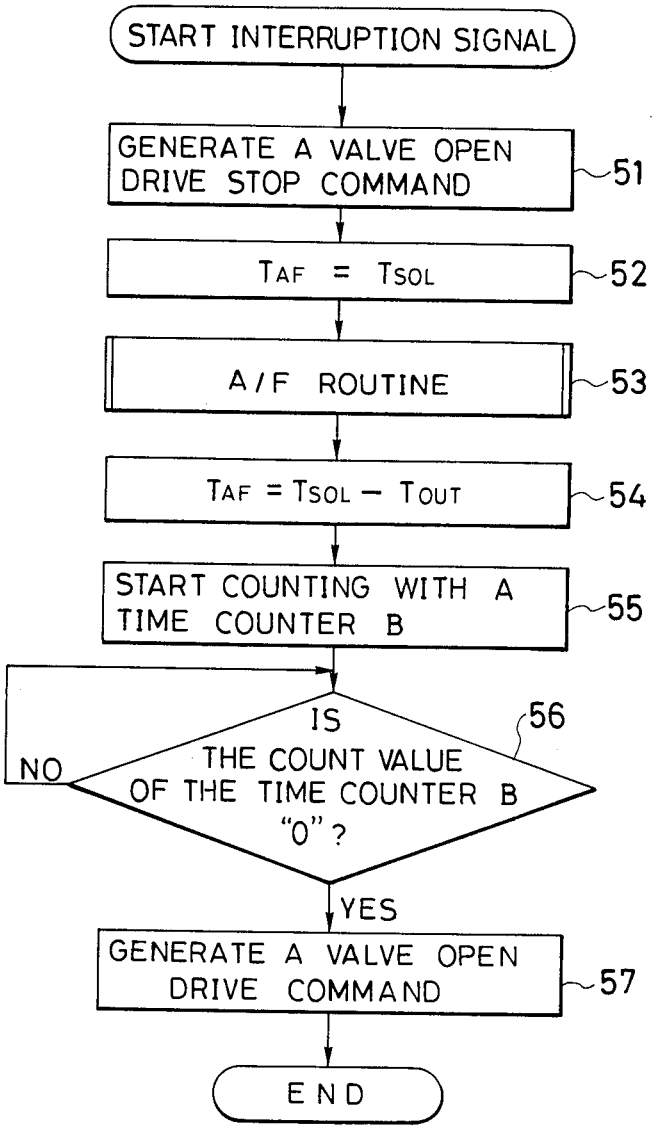
Figure 5:
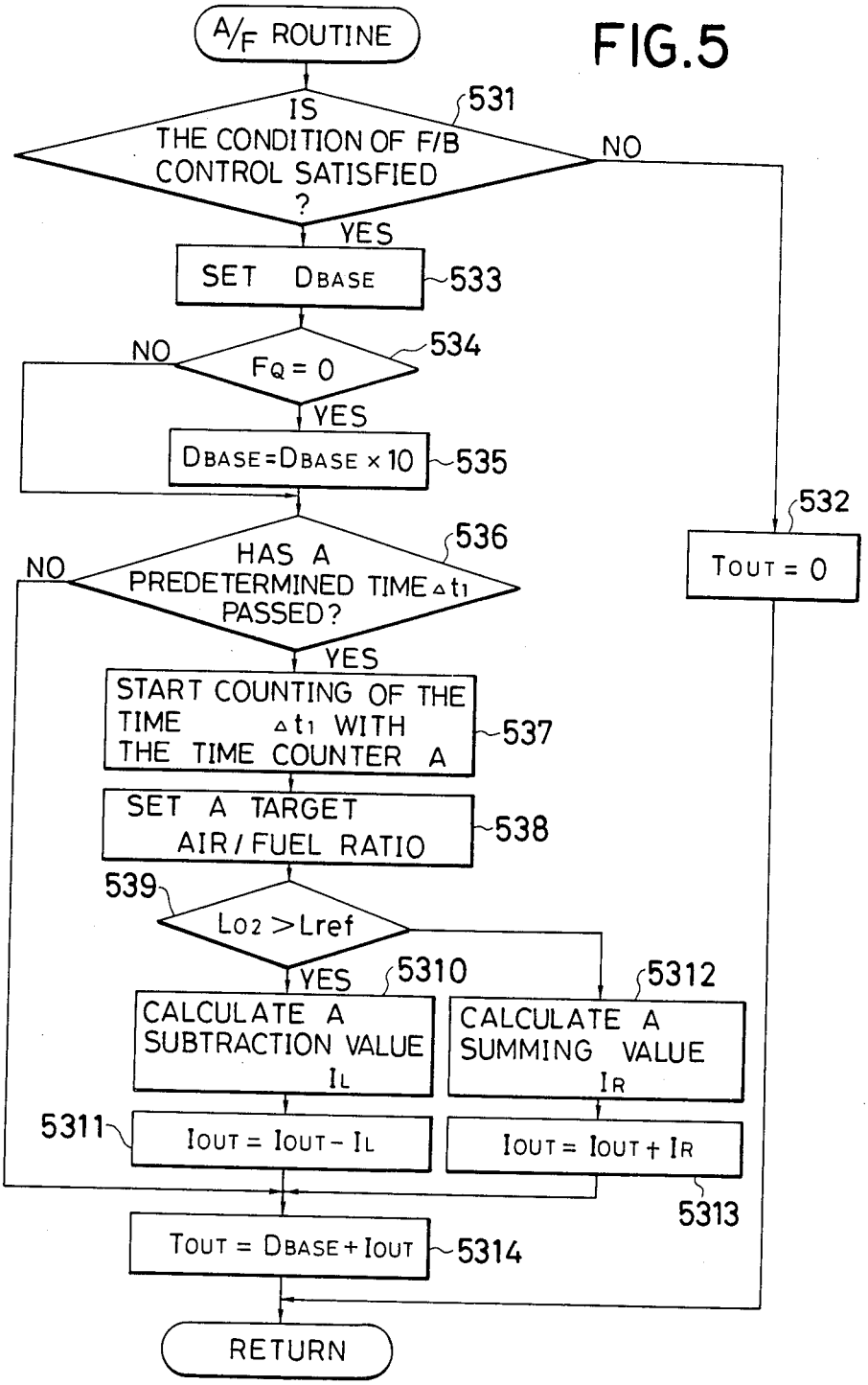

As shown in FIG. 4, at a step 51, a second valve open drive stop command signal is generated in the CPU 29 and supplied to the drive circuit 28a, at every time of the generation of the internal interruption signal in the CPU 29. With this signal, the drive circuit 28a is controlled to close the first open-close solenoid valve 9. This operation is provided so as to prevent malfunctions of the first open-close solenoid valve 9 during the calculating operation of the CPU 29. Next, a valve close period $T_{AF}$ of the first open-close solenoid valve 9 is made equal to a period of one duty cycle $T_{SOL}$ at a step 52, and an A/F routine for calculating a valve open period $T_{OUT}$ of the first open-close solenoid valve 9 which is shown in FIG. 5 is carried out through steps generally indicated at 53.

Figure 6:
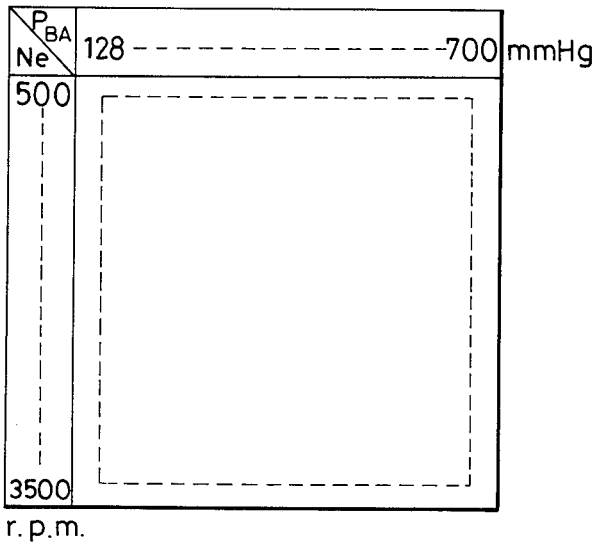
FIG. 6 is a diagram showing a $D_{BASE}$ data map which is previously stored in a ROM 30 of the control circuit 20.

In the A/F routine, whether or not the operating state of the vehicle (including operating states of the engine) satisfies a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air/fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the first open-close solenoid valve 9 is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 6, and the CPU 29 at first reads present values of the absolute pressure $P_{BA}$ and the engine speed $N_e$ and in turn searches a value of the period of base duty ratio $D_{BASE}$ corresponding to the read values from the $D_{BASE}$ date map in the ROM 30. After the setting of the period of base duty ratio, whether or not the intake air amount flag $F_Q$ is equal to "0" is detected at a step 534. If $F_Q=0$, the period of base duty ratio is multiplied by 10 (ten) at a step 535. Then, whether or not a count period of a time counter A incorporated in the CPU 29 (not shown) has reached a predetermined time period $\Delta t_1$ is detected at a step 536. This predetermined time period $\Delta t_1$ corresponds to a delay time from a time of the supply of the air intake side secondary air to a time in which a result of the supply of the air intake side secondary air is detected by the $O_2$ sensor 11 as a change in the oxygen concentration of the exhaust gas. When the predetermined time period $\Delta t_1$ has passed after the time counter A is reset to start the counting of time, the counter is reset again, at a step 537, to start the counting of time from a predetermined initial value. In other words, a detection as to whether or not the predetermined time period $\Delta t_1$ has passed after the start of the counting of time from the intital value by the time counter A, i.e. the execution of the step 537, is performed at the step 536. After the start of the counting of the predetermined time period $\Delta t_1$ by the time counter A in this way, a target air/fuel ratio which is leaner than the stoichiometric air/fuel ratio is set at a step 538.

For setting this target air/fuel ratio, various values for the reference level Lref which is determined according to the values of the absolute pressure within the intake manifold $P_{BA}$ and the engine speed $N_e$ as in the case of the $D_{BASE}$ data map, are previously stored in the ROM 30 as an A/F data map. The CPU 29 searches a value of the reference level Lref from the A/F data map in the ROM 30 using present values of the absolute pressure $P_{BA}$ and the engine speed $N_e$. After the set of the reference value Lref in this way, whether or not the output signal level of the $O_2$ sensor 14 is greater than the reference value Lref determined at the step 538 is detected at a step 539. In other words, whether or not the air/fuel ratio of mixture is leaner than the target air/fuel ratio is detected at the step 539. If $LO_2>Lref$, it means that the air/fuel ratio of the mixture is leaner than the target air/fuel ratio, a subtraction value $I_L$ is calculated at a step 5310. The subtraction value $I_L$ is obtained by multiplication among a constant $K_1$, the engine speed $N_e$, and the absolute pressure $P_{BA}$, ($K_1 \cdot N_e \cdot P_{BA}$), and is dependent on the amount of the intake air of the engine 5. After the calculation of the subtraction value $I_L$, a correction value $I_{OUT}$ which is previously calculated by the execution of operations of the A/F routine is read out from a memory location $a_l$ in the RAM 31. Subsequently, the subtraction value $I_L$ is subtracted from the correction value $I_{OUT}$, and a result is in turn written in the memory location $a_l$ of the RAM 31 as a new correction value $I_{OUT}$, at a step 5310. On the other hand, if $LO_2 \leqq Lref$ at the step 539, it means that the air/fuel ratio is richer than the target air/fuel ratio. Then a summing value $I_R$ is calculated at a step 5312. The summing value $I_R$ is calculated by a multiplication among a constant value $K_2$ ($\neq K_1$), the engine speed $N_e$, and the absolute pressure $P_{BA}$ ($K_2 \cdot N_e \cdot P_{BA}$), and is dependent on the amount of the intake air of the engine 5. After the calculation of the summing value $I_R$, the correction value $I_{OUT}$ which is previously calculated by the execution of the A/F routine is read out from the memory location $a_l$ of the RAM 31, and the summing value $I_R$ is added to the read out correction value $I_{OUT}$. A result of the summation is in turn stored in the memory location $a_l$ of the RAM 31 as a new correction value $I_{OUT}$ at a step 5313. After the calculation of the correction value $I_{OUT}$ at the step 5311 or the step 5313, the correction value $I_{OUT}$ and the period of base duty ratio $D_{BASE}$ set at the step 533 are added together, and a result of addition is used as the valve open period $T_{OUT}$ at a step 5314.

Additionally, after the reset of the time counter A and the start of the counting from the initial value at the step 537, if it is detected that the predetermined time period $\Delta t_1$ has not yet passed, at the step 536, the operation of the step 5314 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$ at a step 54. Subsequently, a value corresponding to the valve close period $T_{AF}$ is set in a time counter B incorporated in the CPU 29 (not shown), and down counting of the time counter B is started at a step 55.

Then whether or not the count value of the time counter B has reached a value "0" is detected at a step 56. If the count value of the time counter B has reached the value "0", a valve open drive command signal is supplied to the drive circuit 28a at a step 57. In accordance with this valve open drive command signal, the drive circuit 28a operates to open the first open-close solenoid valve 9. The opening of the first open-close solenoid valve 9 is continued until a time at which the operation of the step 51 is performed again. If, at the step 56, the count value of the time counter B has not reached the value "0", the step 56 is executed repeatedly.

Thus, in the air intake side secondary air supply system according to the present invention, the first open-close solenoid valve 9 is closed immediately in response to the generation of the internal interruption signal INT, to stop the supply of the air intake side secondary air to the engine 5. When the valve close time $T_{AF}$ for the first open-close solenoid valve 9 within the period of one duty cycle $T_{SOL}$ is calculated and the valve close time $T_{AF}$ has passed after the generation of the interruption signal, the first open-close solenoid valve 9 is opened to supply the air intake side secondary air to the engine through the air intake side secondary air supply passage 8. Thus, the duty ratio control of the supply of the air intake side secondary air is performed by repeatedly executing these operations.

In the air intake side secondary air supply system according to the present invention, the second open-close solenoid valve 17 is opened when the amount of the intake air of the engine is medium or large. Under this condition, the output valve open time period $T_{OUT}$ for controlling the first open-close solenoid valve is obtained by correcting the period of base duty ratio $D_{BASE}$ set at the step 533 in response to the output signal of the $O_2$ sensor. When, on the other hand, the amount of the intake air of the engine is small, the second open-close solenoid valve 17 is closed, and the output valve open period $T_{OUT}$ is determined by correcting a period of base duty ratio $D_{BASE}$, which is obtained by multiplying the period of base duty ratio $D_{BASE}$ set at the step 533 ten times, in response to the output signal of the $O_2$ sensor 14. By the operation of the drive circuit 28a, the first open-close solenoid valve 9 is opened for the output valve open period $T_{OUT}$ in each duty cycle $T_{SOL}$. Thus, when the amount of the intake air is small, the secondary air is supplied into the intake manifold 4 only through the orifice 18, the amount of the secondary air is, as mentioned before, one tenth of the amount of the secondary air which can flow through the air intake side secondary air supply passage 8 when the second open-close solenoid valve 17 is open.

Thus, the air intake side secondary air supply system according to the present invention is provided with a device for limiting the amount of the secondary air flowing through the air intake side secondary air supply passage when the amount of the intake air of the engine is small. Therefore, even when the amount of the intake air is small a very accurate control of the air/fuel ratio is enabled by using the operational range of the open-close solenoid valve, in which range the amount of the secondary air accurately follows the duty ratio of the control signal. In other words, a portion of the duty ratio range in which the linearity of the operation of the open-close valve is good can be always utilized according to the present invention. In this way, the accuracy of the air/fuel ratio control is maintained also when the amount of the intake air of the engine is small, and the engine operation during idling is stabilized.

Turning to FIGS. 7 through 11, the second embodiment of the air intake side secondary system will be explained hereinafter.

Figure 7:
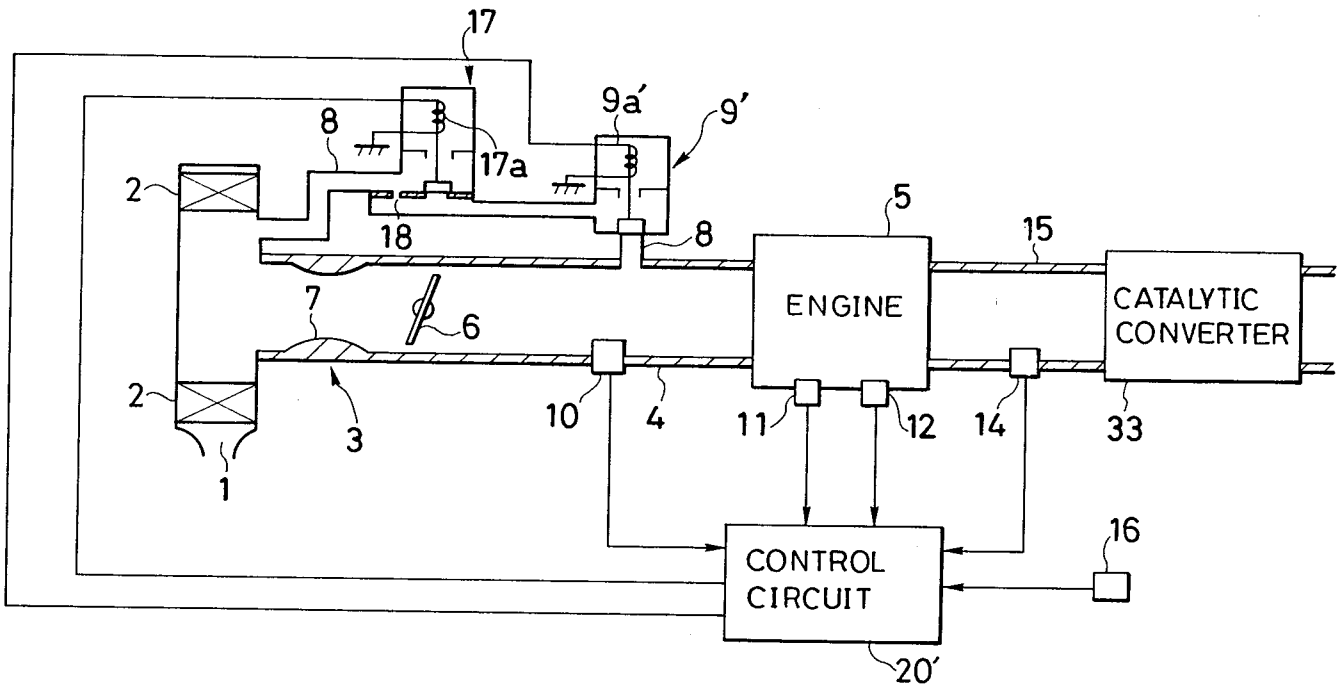
FIG. 7 is a schematic diagram similar to FIG. 1, showing a general construction of a second embodiment of the air intake side secondary air supply system according to the invention.

As shown in FIG. 7, the basic construction of the system is identical with the system shown in FIG. 1 except that a linear type solenoid valve 9' having a solenoid 9a' is provided in place of the open solenoid valve 9. An opening degree of the solenoid valve 9' is varied in response to a magnitude of a current supplied to the solenoid 9a'. Further, the control circuit is denoted by 20' since its operation is slightly different from that of the control circuit 20 in FIG. 1. The reference numeral 17 denotes an open-close solenoid valve which is the same as the second open-close solenoid valve 17 in FIG. 1, however, this valve 17 is denoted simply as the open-close solenoid valve in this embodiment. Since the construction and the operation of the other parts shown in FIG. 7 are the same as those of the parts shwon in FIG. 1, the explanation thereof will not be repeated.

Figure 8:
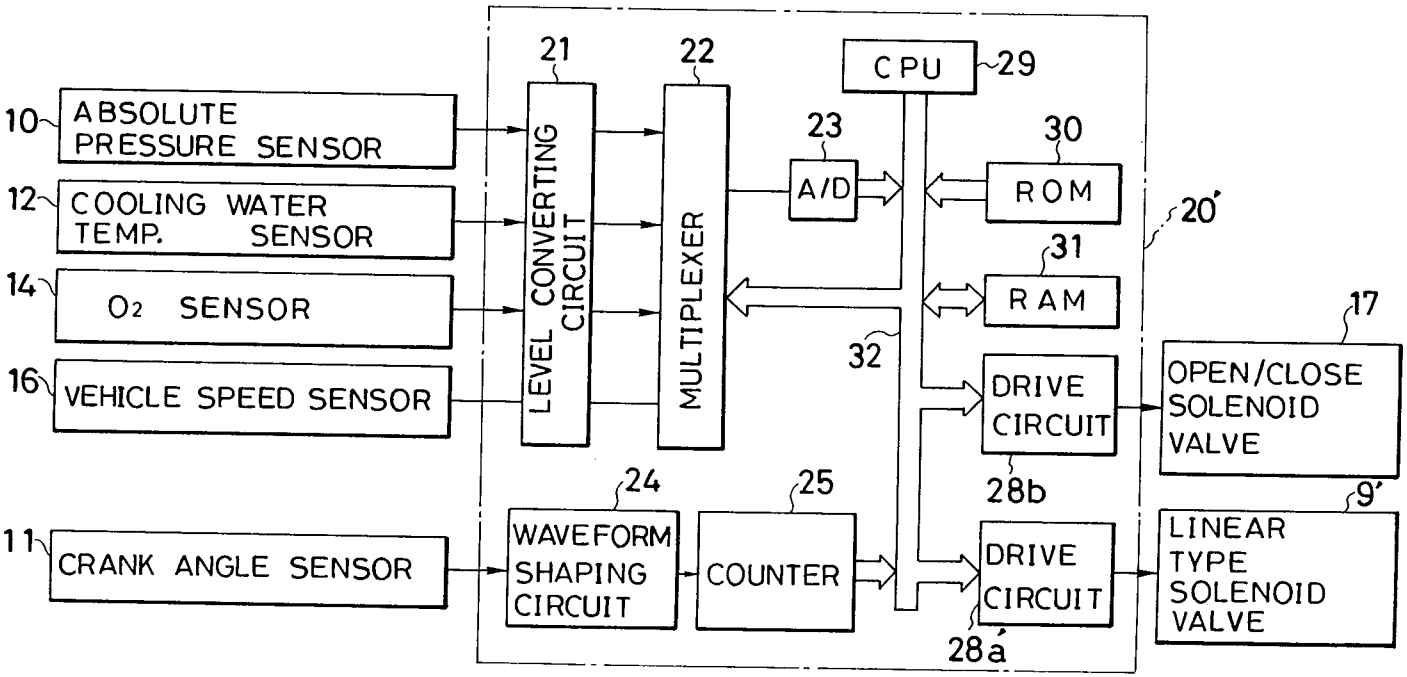
FIG. 8 is a block diagram showing the construction of the control circuit 20' of the system of FIG. 7.

FIG. 8 shows the construction of the control circuit 20' which controls the linear type solenoid valve 9' and the open-close solenoid valve 17. The construction of the control circuit 20' is substantially the same as the construction of the control circuit 20 shown in FIG. 2. It is to be noted, however, a drive circuit 28a' different from the drive circuit 28a shown in FIG. 2 is provided and the solenoid 9a' of the solenoid valve 9' is connected in series with a drive transistor (not shown) of a drive circuit 28a' and a resistor for detecting a current value (also not shown). A power voltage is supplied across two terminals of this series circuit.

The operation of the CPU 29 of the control circuit 20' will be explained hereinafter.

At first, the CPU 29 produces internal interruption signals as in the case of the first embodiment. In response to this internal interruption signal, the CPU 29 provides a current supply value $D_{OUT}$ for the solenoid 9a' of the solenoid 9' and supplies it to the drive circuit 28a'. The drive 28a' performs a closed loop control operation so that the magnitude of current flowing through the solenoid 9a' becomes equal to the current supply value $D_{OUT}$. Apart from the operation in response to the internal interruption signal, the CPU 29 determines whether or not the open-close solenoid valve 17 is to be opened at intervals of a predetermined time period or in synchronism with the rotation of the engine as in the case of the previous embodiment. When it is determined that the open-close solenoid valve 17 is to be opened, the CPU provides a valve open command signal to the drive circuit 28b so that the open-close solenoid valve 17 is opened.

Similarly, steps for detecting the amount of intake air of the engine 5 which is illustrated in FIG. 3 are also performed in this embodiment.

Figure 9:
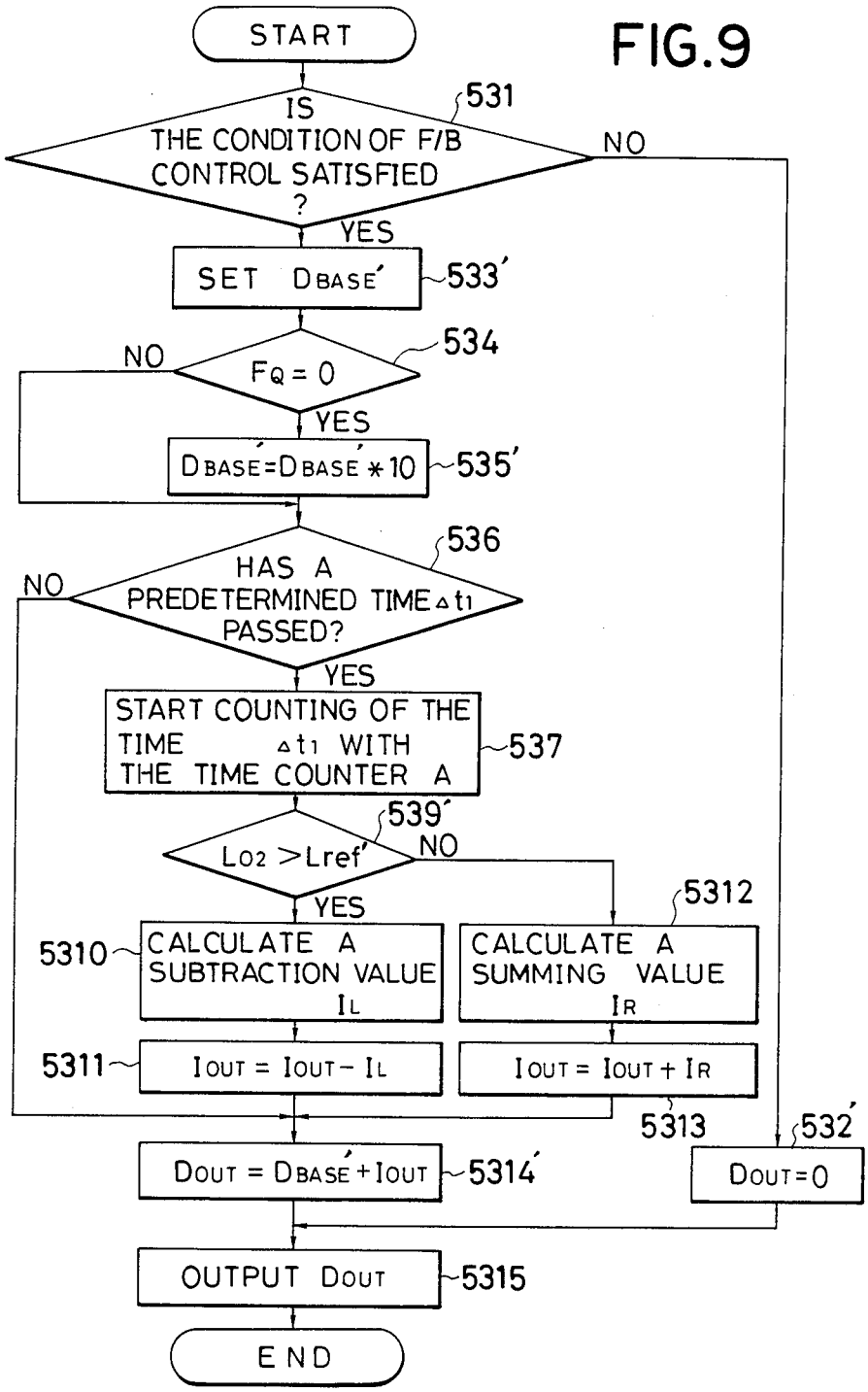
FIG. 9 is a flowchart similar to FIG. 5, showing the manner of operation of a CPU 29 in the control circuit 40' in the second embodiment of the present invention.
Figure 10:
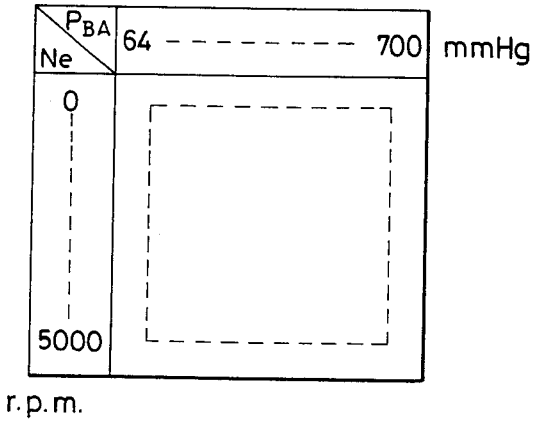
FIG. 10 is a diagram showing a $D_{BASE}'$ data map which is previously stored in a ROM 30 of the control circuit 20'.
Figure 11:
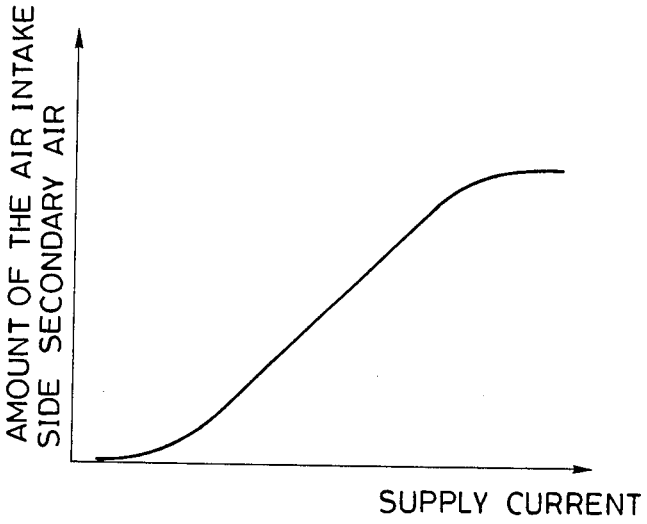
FIG. 11 is a diagram showing a relationship between a magnitude of a current supplied to the solenoid valve 9' and an amount of the secondary air in the second embodiment of the present invention.

Then, as shown in FIG. 9, whether or not the operating state of the vehicle (including operating states of the engine) satisfies a condition for the feedback (F/B) control is detected at a step 531 as in the A/F routine of the previous embodiment. If it is determined that the condition for the feedback control is not satisfied, the current supply value $D_{OUT}$ is made equal to "0" at a step 532' to stop the air/fuel ratio feedback control. On the other hand, if it is determined that the condition for the feedback control is satisfied, a base value $D_{BASE'}$ of the current to be supplied to the solenoid valve 9' is set at a step 533'. Various values of the base value $D_{BASE'}$ which are determined according to the absolute pressure within the intake manifold $P_{BA}$ and the engine speed $N_e$ are previously stored in the ROM 30 in the form of a $D_{BASE'}$ data map as shown in FIG. 10, and the CPU 29 at first reads present values of the absolute pressure $P_{BA}$ and the engine speed $N_e$ and in turn searches a value of the period of base duty ratio $D_{BASE}$ corresponding to the read values from the $D_{BASE}$ date map in the ROM 30. After the setting of the period of base duty ratio, whether or not the intake air amount flag $F_Q$ is equal to "0" is detected at the step 534. If FIG. 10, the base value $D_{BASE'}$ is multiplied by 10 (ten) at a step 535'. Then, whether or not a count period of the time counter A incorporated in the CPU 29 (not shown) has reached the predetermined time period $\Delta t_1$ is detected at the step 536. When the predetermined time period $\Delta t_1$ has passed after the time counter A is reset to start the counting of time, the counter is reset again, at the step 537, to start the counting of time from the predetermined initial value. After the start of the counting of the predetermined time period $\Delta t_1$ by the time counter A in this way, whether or not the output signal level of the $O_2$ sensor 14 is greater than the reference value Lref' corresponding to a target air/fuel ratio is detected at a step 539'. In other words, whether or not the air/fuel ratio of mixture is leaner than the target air/fuel ratio is detected at the step 539'. If $LO_2 > Lref'$, it means that the air/fuel ratio of the mixture is leaner than the target air/fuel ratio, the subtraction value $I_L$ is calculated at the step 5310. After the calculation of the subtraction value $I_L$, the correction value $I_{OUT}$ which is previously calculated by the execution of operations of the A/F routine is read out from the memory location $a_l$ in the RAM 31. Subsequently, the subtraction value $I_L$ is subtracted from the correction value $I_{OUT}$, and a result is in turn written in the memory location $a_l$ of the RAM 31 as a new correction value $I_{OUT}$, at a step 5310. On the other hand, if $LO_2 > Lref'$ at the step 539', it means that the air/fuel ratio is richer than the target air/fuel ratio. Then the summing value $I_R$ is calculated at the step 5312. After the calculation of the summing value $I_R$, the correction valve $I_{OUT}$ which is previously calculated by the execution of the A/F routine is read out from the memory location $a_l$ of the RAM 31, and the summing value $I_R$ is added to the read out correction value $I_{OUT}$. A result of the summation is in turn stored in the memory location $a_l$ of the RAM 31 as a new correction value $I_{OUT}$ value $I_{OUT}$ at the step 5311 or the step 5313, the correction value $I_{OUT}$ and the base value $D_{BASE'}$ set at the step 533' or the step 535' are added together, and a result of addition is used as the current supply value $D_{OUT}$ at a step 5314'. Than the current supply value $D_{OUT}$ is supplied to the drive circuit 28a' at a step 5315.

The drive circuit 28a' operates as follows. At first the magnitude of the current flowing through the solenoid 9a' of the solenoid valve 9' is detected. Then the detected manitude of the current flowing through the solenoid current supply value $D_{OUT}$ and aforementioned drive transistor is on-off controlled in response to a result of the comparison, to supply the drive current to the solenoid 9a'. Thus, the current flowing through the solenoid 9a' becomes equal to the current supply value $D_{OUT}$. In this way, the secondary air whose amount varies in proportion to the change in the magnitude of the current flowing through the solenoid 9a' of the solenoid valve 9' is supplied to the intake manifold 4.

It will be appreciated from the foregoing, in the second embodiment of the air intake side secondary air supply system of the present invention, the open-close solenoid valve 17 is opened when the amount of the intake air of the engine is medium or large. Under this condition, the current supply value $D_{OUT}$ is determined by correcting the base value $D_{BASE'}$ set at the step 533' in response to the output signal of the $O_2$ sensor. When, on the other hand, the amount of the intake air of the engine is small, the open-close solenoid valve 17 is closed, and the current supply value $D_{OUT}$ is determined by correcting a base value $D_{BASE'}$, which is obtained by multiplying the base value $D_{BASE'}$ set at the step 533' ten times, in response to the output signal of the $O_2$ sensor 14. By the operation of the drive circuit 28a', the solenoid 9a' of the solenoid valve 9' is supplied with the drive current whose magnitude is equal to the current value $D_{OUT}$. The solenoid valve 9' opens at a degree responsive to the current value $D_{OUT}$. Thus, when the amount of the intake air is small, the secondary air is supplied into the intake manifold 4 only through the orifice 18, the amount of the secondary air is, as mentioned before, one tenth of the amount of the secondary air which can flow through the air intake side secondary air supply passage 8 when the second open-close solenoid valve 17 is open.

Additionally, after the reset of the time counter A and the start of the counting from the initial value at the step 537, if it is detected that the predetermined time period $\Delta t_1$ has not yet passed, at the step 536, the operation of the step 5314' is immediately executed as in the case of the previous embodiment. In this case, the correction value $I_{OUT}$ calculated by the routine up to the previous cycle is read out.

Thus, the air intake side secondary air supply system according to the present invention is provided with a device for limiting the amount of the secondary air flowing through the air intake side secondary air supply passage when the amount of the intake air of the engine is small. Therefore, even when the amount of the intake air is small a very accurate control of the air/fuel ratio is enabled by using the operational range of the linear type solenoid valve, in which range the amount of the secondary air accurately follows the magnitude of the crive current. In other words, a portion of the duty ratio range in which the linearity of the operation of the linear type solenoid valve is good can be always utilized according to the present invention. In this way, the accuracy of the air/fuel ratio control is maintained also when the amount of the intake air of the engine is small, and the engine operation during idling is stabilized.

What is claimed is:

1. An air intake side secondary air supply system for an internal combustion engine having an intake air passage with a carburettor and an exhaust gas passage, comprising:

an air intake side secondary air supply passage leading to the intake air passage, at a position downstream of said carburettor;

a first open-close valve disposed in said air intake side secondary air supply passage;

an oxygen concentration sensor disposed in said exhaust passage and producing an output signal;

duty control unit responsive to said output signal of said oxygen concentration sensor and connected to said first open-close valve, operative to repeatedly calculate a valve open time period in a duty cycle in response to a result of determination of air/fuel ratio by using said output signal of said oxygen concentration sensor, and opening said first open-close valve during said output valve open time period in each of said duty cycle;

means for detecting an amount of an intake air of said internal combustion engine; and means for restricting an amount of said air intake side secondary air flowing through said air intake side secondary air supply passage when the amount of said intake air is smaller than a predetermined level.

2. A system as set forth in claim 1, wherein said means for restricting comprise a second open-close valve provided in said air intake side secondary air supply passage and adapted to close when the amount of said intake air is smaller than a predetermined level, and a bypass passage with a restrictor which bypasses said second openclose valve.

3. A An air intake side secondary air supply system for an internal combustion engine having an intake air passage with a carburettor, comprising:

an air intake side secondary air supply passage leading to the intake air passage, at a position downstream of said carburettor;

a solenoid valve disposed in said air intake side secondary air supply passage whose opening degree is controlled by a magnitude of a drive current, to continuously vary an amount of an air intake side secondary air flowing through said air intake side secondary air supply passage;

an oxygen concentration sensor disposed in said exhaust passage and producing an output signal;

control means for determining said magnitude of said drive current of said solenoid valve, by correcting a base current valve in response to a concentration of an exhaust gas component of said internal combustion engine;

current supply means for supplying said drive current to said solenoid valve whose magnitude is determined by said control means;

means for detecting an amount of an intake air of said internal combustion engine; and means for restricting an amount of said air intake side secondary air flowing through said air intake side secondary air supply passage when the amount of said intake air is smaller than a predetermined level.

4. A system as set forth in claim 3, wherein said means for restricting comprise an open-close valve provided in said air intake side secondary air supply passage and adapted to close when the amount of said intake air is smaller than a predetermined level, and a bypass passage with a restrictor which bypasses said second open-close valve.

* * * * *